US005188465A

United States Patent [19]

Johnson et al.

[11] Patent Number: 5,188,465

[45] Date of Patent: Feb. 23, 1993

[54] RMS POWER CONTROLLER FOR DOT-MATRIX PRINTERS

[75] Inventors: William M. Johnson, Lexington; George K. Parish, Winchester, both of Ky.

[73] Assignee: International Business Machines Corporation, Armonk, N.Y.

[21] Appl. No.: 662,648

[22] Filed: Mar. 1, 1991

[51] Int. Cl.[5] ..... B41J 2/30

[52] U.S. Cl. ..... 400/121; 101/93.29

[58] Field of Search ..... 400/54, 157.2, 121; 101/93.29; 363/40, 41

[56] References Cited

U.S. PATENT DOCUMENTS

| | | | |
|---|---|---|---|
| 4,236,447 | 12/1980 | Matsuzaki et al. | 101/93.14 |
| 4,566,813 | 1/1986 | Kobayashi et al. | 400/120 |
| 4,653,940 | 3/1987 | Katsukawa | 400/121 |
| 4,705,412 | 11/1987 | Matsumoto | 400/54 |

OTHER PUBLICATIONS

Basic Circuit Theory by Desoer and Kuh 1969, pp. 321-322.

Pages 406-408 of "Basic Engineering Circuit Analysis".

*Primary Examiner*—David A. Wiecking
*Assistant Examiner*—Steven S. Kelley
*Attorney, Agent, or Firm*—A. P. Tennent

[57] ABSTRACT

Method and apparatus for use with dot-matrix printers to ensure that the maximum heat dissipation of critical components associated with the printhead is not exceeded during high density printing. The number of dots to be printed are determined by a counting technique which takes into consideration the thermal time constant of a critical component and the filter time constant of the power controlling or supplying components. These considerations allow the counting of output dots to be accurately transformed by a single dot power conversion factor into an accurate representation of the power in the critical components. The dot counts are divided into time intervals dependent upon a filter time constant and a thermal time constant. The dot counts are squared, summed and rooted to produce an RMS value which accurately predicts the power which produces the heat dissipation in the critical components.

15 Claims, 4 Drawing Sheets

Fig. 4.
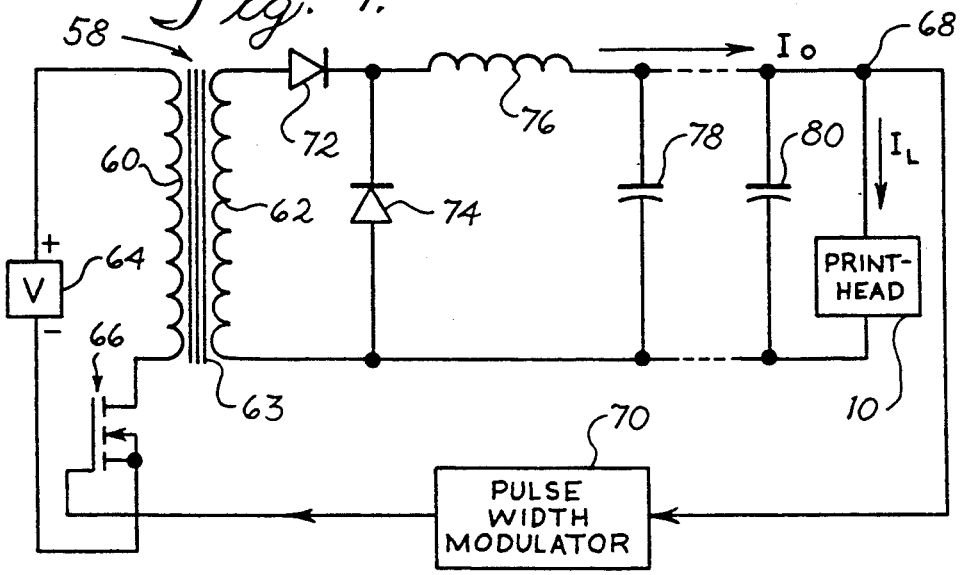
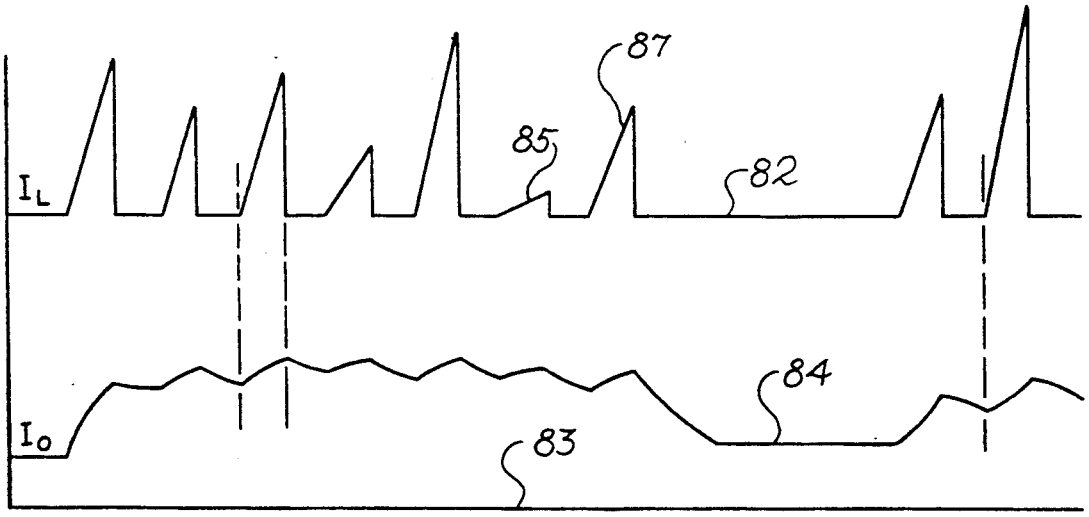
Fig. 5.

DOTS
9
8
7
6
5
4
3
2
1
0
TTC1
TTC2
90
92
88
FTC1
FTC2
FTCN
94
96
98
100
102
104

RMS POWER CONTROLLER FOR DOT-MATRIX PRINTERS

BACKGROUND OF THE INVENTION

1. Field of the Invention

This invention relates, in general, to printing and more specifically to controlling the heat dissipation of electrical components used in printing apparatus.

2. Description of the Prior Art

Dot-matrix printers are available in several different types, including wire or pin impact printers, thermal printers, ink jet printers, and printers which use special laser diode arrays to write images onto a photosensitive member. Although the basic form of these printers is different, each can use a printhead which has more than one dot producing or defining device in the printhead which is electrically controlled or activated. For most printing applications, less than the full number of devices will be activated at every possible position, or option, during the printing operation. However, this cannot usually be guaranteed and some means must exist which protects the electrical components supplying and controlling the printhead from excessive heat dissipation. For economy reasons, most printing apparatus is designed to have electrical components capable of withstanding the head dissipation required in normal printing applications. When the requirements become more demanding, the printers usually have some means for compensating for the extra heat which would be generated by these stringent requirements. This allows the heat dissipating components to be safely sized at the more normal usage requirements.

One method of controlling the heat dissipation is to slow the effective head speed by stopping the printhead momentarily at the end of a line, printing the required dots with more than one pass of the printhead or changing the velocity of the head as it moves across the imaging or printing media. A dot counting technique is frequently used to predict, or calculate in real time, the number of dots to be printed during a predetermined time interval or during a predetermined length of line scan of the printhead. If the calculated or measured values exceed a limit value, the printhead speed is effectively slowed. While this type of head dissipation control is effective in some applications, conventional dot counting does not provide for the most accurate control of excessive heat buildup in critical components of the system. This is so because conventional counting techniques inherently produce an average value for the electrical current which is used to produce the heat. In actual operation, the waveform of the current or power supplying the printhead is irregular and the more exact predictor of heat producing power would be a method which considers the RMS value of the current being monitored. U.S. Pat. No. 4,653,940, issued on Mar. 31, 1987, teaches a dot counting system for use with a dot-matrix printer. In this patent, a technique is used to prevent an abnormal rise in temperature of the printhead when dots are formed continuously with a relatively high density. A fixed interval of time is determined wherein a known heat dissipation rate is assumed. The rate is equated to dot counts and a running tabulation of counts is processed which subtracts a fixed number of counts from the running total during every passage of the fixed time interval. The system purportedly compensates for a known rate of heat loss from the apparatus during the counting sequence, although the calculations are based upon average power levels rather than more accurate power levels determined from RMS currents.

Therefore, it is desirable, and an object of this invention, to provide an efficient power controlling system for dot-matrix printheads which uses RMS current quantities and calculations for determining the need to slow the printhead speed. It is also desirable, and another object of this invention, to provide a system wherein current fluctuations in the supplied power, which are not seen by or influence the heat buildup in the protected components, are not unnecessarily used to influence the calculations made by the controlling method.

SUMMARY OF THE INVENTION

There is disclosed herein a new and useful system for determining when the power supplying or controlling components of a dot-matrix printhead might exceed their design power ratings during high density printing. If it is determined that these components may exceed their power ratings and fail due to excessive temperature buildup, the effective speed of the printhead is slowed to bring the power dissipation within the design limits. Instead of measuring the power directly with electrical sensors, a dot counting technique is used to determine the number of dots which will be printed by the printhead and to translate the dot count into a power level indicative of the power which must be dissipated in critical components of the apparatus. Even though the dot count is indicative of the power in the output portion of the printhead, these power calculations can be accurately translated to other components of the system by properly processing the dot counts based upon thermal and filter time constants of the apparatus.

According to a specific embodiment of the invention, the number of dots to be printed within a predetermined thermal time constant (TTC) window are divided into a plurality of filter time constant intervals. The sum of the dots for each filter time constant (FTC) interval are separately squared and added to each other to provide a squared-summed value indicative of the dots contained within the thermal time constant window. The square root of the result is obtained to provide an RMS value and a conversion factor is used to convert the value into an RMS current quantity. The conversion factor relates to the amount of current needed to produce one dot. When the calculated current provided by this method exceeds a predetermined limit, the effective speed of the printhead is changed so that the actual power limit of the apparatus is not exceeded.

The thermal time constant time interval which governs the time over which the RMS current value is determined allows the determined value to control the system quickly enough to prevent destructive heat buildup in the critical components of the printer. The filter time constant periods relate to the output filter of the power supply system, or to other controlled components having a filter time constant. By taking these periods into account during the counting process, the peak transients that are included in the dot count waveform are not reflected into the power value thereby established. This is desirable since they are filtered by the filtering components of the power supply and do not truly reflect the power level which causes heat in the critical components of the power supply. In order to be efficient, the dot count technique, even when using RMS current calculations, must be sufficiently short enough to be within the window of a thermal time constant period. However, it must still be long enough to keep the transients in the output load current from unduly influencing the RMS current value translated back to the components which are before the output filter of the power supply.

BRIEF DESCRIPTION OF THE DRAWINGS

Further advantages and uses of this invention will become more apparent when considered in view of the following detailed description and drawings, in which:

FIG. 4 is a schematic diagram of a power supply connected to a printhead;

FIG. 5 is a graph illustrating waveforms in the circuit of FIG. 4;

DESCRIPTION OF THE PREFERRED EMBODIMENTS

Figure 1:
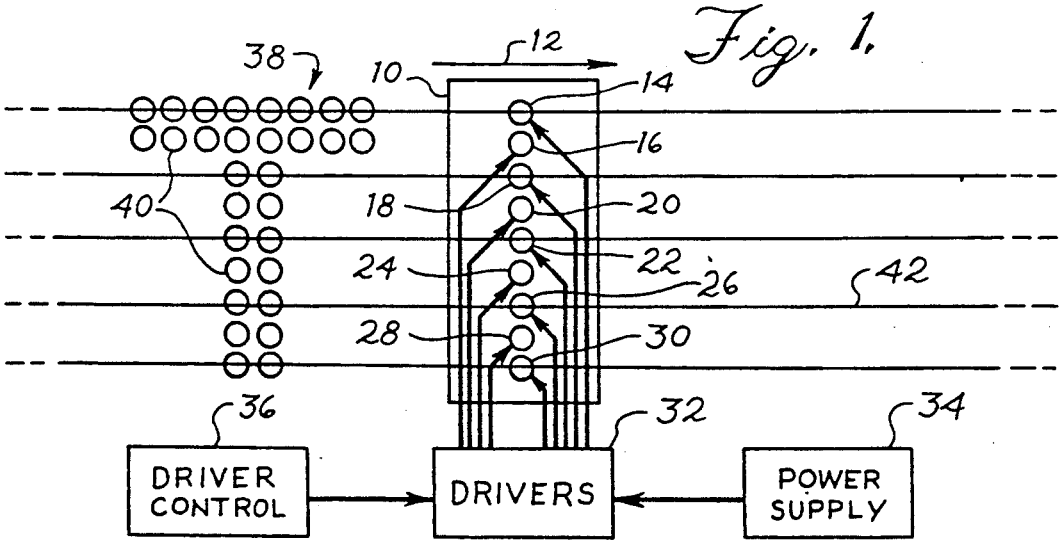
FIG. 1 is a diagram showing a dot-matrix type printhead and its associated components.

Throughout the following description, similar reference characters refer to similar elements or members in all of the figures of the drawings.

Referring now to the drawings, and to FIG. 1 in particular, there is shown a dot-matrix printhead 10 of the type capable of using the present invention. The printhead 10 moves in direction 12 to scan across the surface or medium on which it is printing. The printing elements or devices 14, 16, 18, 20, 22, 24, 26, 28 and 30 are, in this specific embodiment, individual pins or wires which can be activated or fired to produce dots on the medium. The wires are fired selectively as the head moves across the printing medium to produce the desired indicia on the medium. Although illustrated in this embodiment as wires used in an impact printer printhead, other forms of dot-matrix printheads may be used within the contemplation of the invention, such as printheads used with thermal printers, ink jet printers, and printers using laser or light emitting diode arrays.

The individual wires in the printhead 10 are driven or energized by the drivers 32 which control the power supplied by the power supply 34. The driver control 36 appropriately activates or sends signals to the proper driver element in response to external information, which is not shown in FIG. 1. With proper control of the drivers 32, a dot-matrix pattern can be produced while the printhead 10 is scanning in direction 12, such as the "T" 38 shown in FIG. 1. "T" 38 is formed by a plurality of dots 40 which have been produced by synchronized and selective firing of the wires in the printhead 10. Alignment lines, such as line 42, illustrate the correspondence between the produced dots and the producing wires.

The density of the printed pattern can vary in actual applications. When more dots must be printed in a shorter time interval of movement of the printhead 10, which directly corresponds to the distance the head travels, the associated components, such as the drivers 32 and the power supply 34, must supply or control more power over a given time interval than when the printhead is producing a smaller number of dots in the same time period. For an economical design, the heat dissipation limits of these devices are usually based upon an average or usual printing density. When the density increases above the usual amount, steps must be taken in the printing device to prevent overheating of the power supplying and controlling components associated with the printhead 10. Instead of measuring currents and voltages existing in these devices, the power can be determined by a dot count of dots produced by the printhead 10. The dot count is transformed into a power value by applying a conversion factor which represents the power needed for the printhead to produce one dot, which is a known quantity for the particular printhead. Therefore, the power needed by the printhead 10 can be determined or predicted by counting the dots produced by the printhead over a given period of time instead of directly measuring the power in the power sensitive components.

Figure 2:
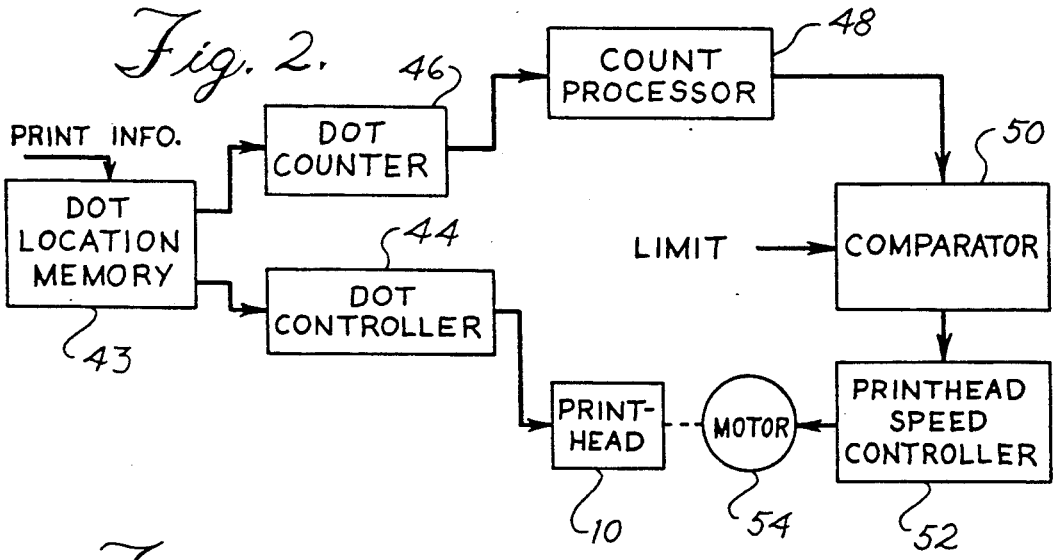
FIG. 2 is a block diagram of the major components used in controlling heat dissipation according to this invention.

FIG. 2 is a block diagram of components used in controlling heat dissipation according to the present invention. These components provide indications of the power needed at the printhead and the power which must be controlled and supplied by the associated components without actually measuring the power by electrical means. According to FIG. 2, the dot location memory 43 contains the bit-map for data derived from print information which indicates which dots must be printed as the printhead scans across the printing medium. This information is transferred to the dot controller 44 which appropriately controls the individual printing wires in the printhead 10. The drivers 32, power supply 34, and driver control 36, shown in FIG. 1 may all be a portion of the dot controller 44 shown in FIG. 2.

The dot location memory 43 is also connected to the dot counter 46 which can determine the number of dots which are to be printed by the printhead during a specific time interval or distance of travel of the printhead 10. Count processor 48 takes the dot counts provided by the counter 46 and processes these counts to determine the power level needed by the printhead associated components to produce these dots. It is emphasized that this may be done ahead of actual printing, or during printing in real time, to accomplish the objectives of the invention.

The power level determined by processor 48 is applied to comparator 50 which compares the determined power level with a power limit to determine if the calculated power level is higher than the critical components in the associated devices can withstand. Depending upon the results of the comparison, the printhead speed controller 52 maintains the speed of the printhead drive motor 54 at the usual speed or slows the motor 54 when the required power level exceeds, or is predicted to exceed, the limit value. Slowing of the motor can be by various means, such as changing the frequency of the voltage driving a stepper type motor, or stopping the motor for a predetermined time interval at the end of a line scan. Effective control or reduction of the printhead power requirements can also be accomplished by altering the number of dots to be printed during a scan so that it takes more than one complete scan to print all of the dots required for that scan. Whatever the controlling method used, it is important that the dot counting method produce an accurate representation of the power needed to be dissipated by the critical components in the associated devices connected to the printhead.

Conventional dot counting techniques applied to printhead power control have typically counted the number of dots to be produced by the printhead over a given period of time. With some types of printing requirements this type of calculation can provide an accurate representation of the power in the system. However, when the density of the printing dots fluctuates widely across the line scan, the conventional method of averaging the dots over a given time period can provide misleading information about the actual power dissipated in the associated components.

Figure 3:
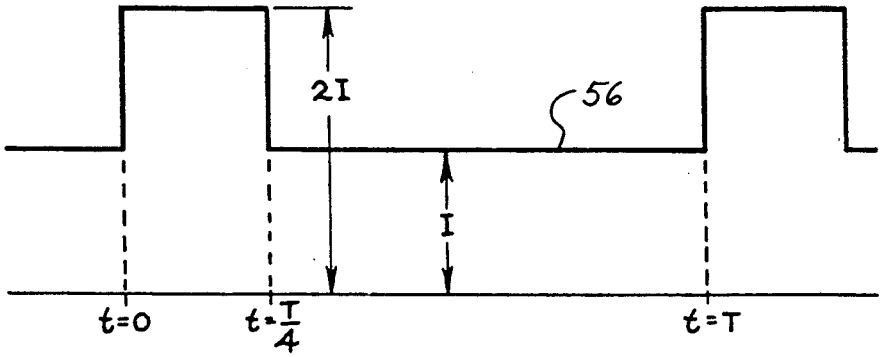
FIG. 3 is a graph used in explaining the relative power differences between RMS and average calculation methods.

Since the power being measured by conventional dot counting methods is represented as an average current quantity, and since actual heating is produced by an RMS current quantity, specific types of power utilization waveforms can produce readings or calculations which are not truly representative of the heating power in the associated devices. FIG. 3 will be used to indicate the possible differences between an average power calculation and an RMS power calculation. Regardless of the waveform of the power, an RMS calculation always is as high or higher than an average power calculation. Although RMS current is used to calculate power according to the product of the square of the RMS current and the resistance, the calculated power is not an RMS power. Instead, the power is an average power which provides a true representation of the heat dissipation. Average current quantities used in the power equation, according to conventional systems, do not provide as accurate an average power calculation as the present invention.

FIG. 3 is a graph used to explain the relative power differences between RMS and average calculation methods. While curve 56 of FIG. 3 may not specifically indicate the currents, or power, actually needed to produce an indicia pattern by a printhead, it is illustrative of power fluctuations which can occur when the printhead produces high density dots during one portion of the scan and low density dots during an adjacent portion of the scan. According to FIG. 3, which represents current as a component of the power quantity, a current of 2I exists between time instants t=0 and t=T/4. During the remainder of the cycle equal to T, the current I exists. The average current represented by this waveform is given by the equation:

$$I_{ave} = 1/T\left[\int_0^{T/4} 2I dt + \int_{T/4}^{T} I dt\right] \quad (1)$$

This can be simplified to:

$$I_{ave}=1/T\,[2I\,T/4+I\,(T-T/4)] \quad (2)$$

$$I_{ave}=10/8\,I=1.25\,I \quad (3)$$

Therefore, in this example, the average current produced by the indicated waveform is 1.25 I. On the other hand, the RMS current represented by the waveform or curve 56 in FIG. 3 is calculated by first determining the mean square value of a current according to the equations:

$$I_{ms} = 1/T\left[\int_0^{T/4} (2I)^2 dt + \int_{T/4}^{T} I^2 dt\right] \quad (4)$$

$$I_{ms}=1/T\,[4I^2T/4+I^2\,(T-T/4)] \quad (5)$$

$$I_{ms}=7/4\,I^2=1.75\,I^2 \quad (6)$$

The mean square current is converted into the root mean square by the equation:

$$I_{rms} = \sqrt{I_{ms}} = 1.32I \quad (7)$$

From these equations, it can be seen that the RMS current, which represents the more accurate value of the actual heating content of the current, is larger than the calculated average current value. Therefore, any calculations made using the average value for current, or the corresponding power produced by the current, may be lower than the actual heating value of the current represented by the RMS value, depending upon the particular waveform of the current. Thus, instead of using average current calculations in the dot counting technique as used in the prior art, this invention uses RMS dot counting techniques to more accurately predict the actual heating power in the associated components.

FIG. 4 is a schematic diagram of a printhead and its associated power supply, and the power supply is of the type which may be used in the present invention. According to FIG. 4, the power supply includes the power transformer 58 which has a primary winding 60 and a secondary winding 62 which are coupled to the core 63. Power is supplied to the primary winding 60 by the DC power source 64 and controlled by the MOS FET switching transistor 66. The transformer 58 and the switching transistor 66 are two of the major components in the power supply system which must be carefully sized according to heat dissipation produced when delivering power to the printhead 10. The power calculations are able to accurately predict the heat dissipation needed to prevent destruction of the power supply components, such as the transformer 58 and the transistor 66. The output voltage of the power supply exists at terminal 68 which is connected to pulse width modulator 70 which controls the conduction time of the switching transistor 66 to maintain the voltage at the desired value. Rectifying diodes 72 and 74 are connected to the secondary winding 62 and convert the secondary voltage into DC voltage which is filtered by the filter inductor 76 and the filter capacitors 78 and 80. Filter capacitor 80 is usually located at the printhead 10 and is normally of a larger capacity than the filter capacitor 78, which is normally located in the power supply. The effective filter time constant of this power supply is determined by the values of components 76, 78 and 80.

The load current $I_L$ flowing through the printhead is different from the output current $I_O$ which is delivered by the power supply because of the filtering characteristics of the inductor 76 and capacitors 78 and 80. Since the load current is different than the output current supplied by the power supply and seen by the primary components of the power supply, such as primary winding 60 and switching transistor 66 calculations based upon the load current supplying the printhead 10 must be appropriately transformed for accurate readings. Thus, the actual implementation of an RMS counting technique in the secondary portion of the power supply must be appropriately accomplished, as in this invention, to accurately indicate the power in the primary portion of the power supply.

FIG. 5 is a graph illustrating waveforms in the circuit of FIG. 4. The output LC filter of the power supply is sized so that the peak current required for the head will be furnished from the capacitor 80, shown in FIG. 4. The load current, $I_L$, is represented by curve 82. As can be seen in FIG. 5, the spikes of different height in curve 82 represent the total current which is indicative of the total power needed to print the dots in a particular dot option, or location in which dots may be produced. In other words, assuming that axis 83 represents scan location, the current used to produce dots corresponding to pulse 85 is less than that required for pulse 87, simply because more dots are to be printed at the location corresponding to pulse 87. The irregular nature of curve 82 is smoothed somewhat by the filtering components of the power supply to produce the actual output current, $I_O$ indicated by curve 84. As can be seen, the curve 84 is different than curve 82 and, therefore an RMS calculation of the current in curve 82 would provide different results than a calculation of the RMS current indicated by curve 84. For this reason, the current or power calculation method of this invention takes into consideration the filter time constant of the power supply in transforming the dot counts into actual power heating quantities.

Figure 6:
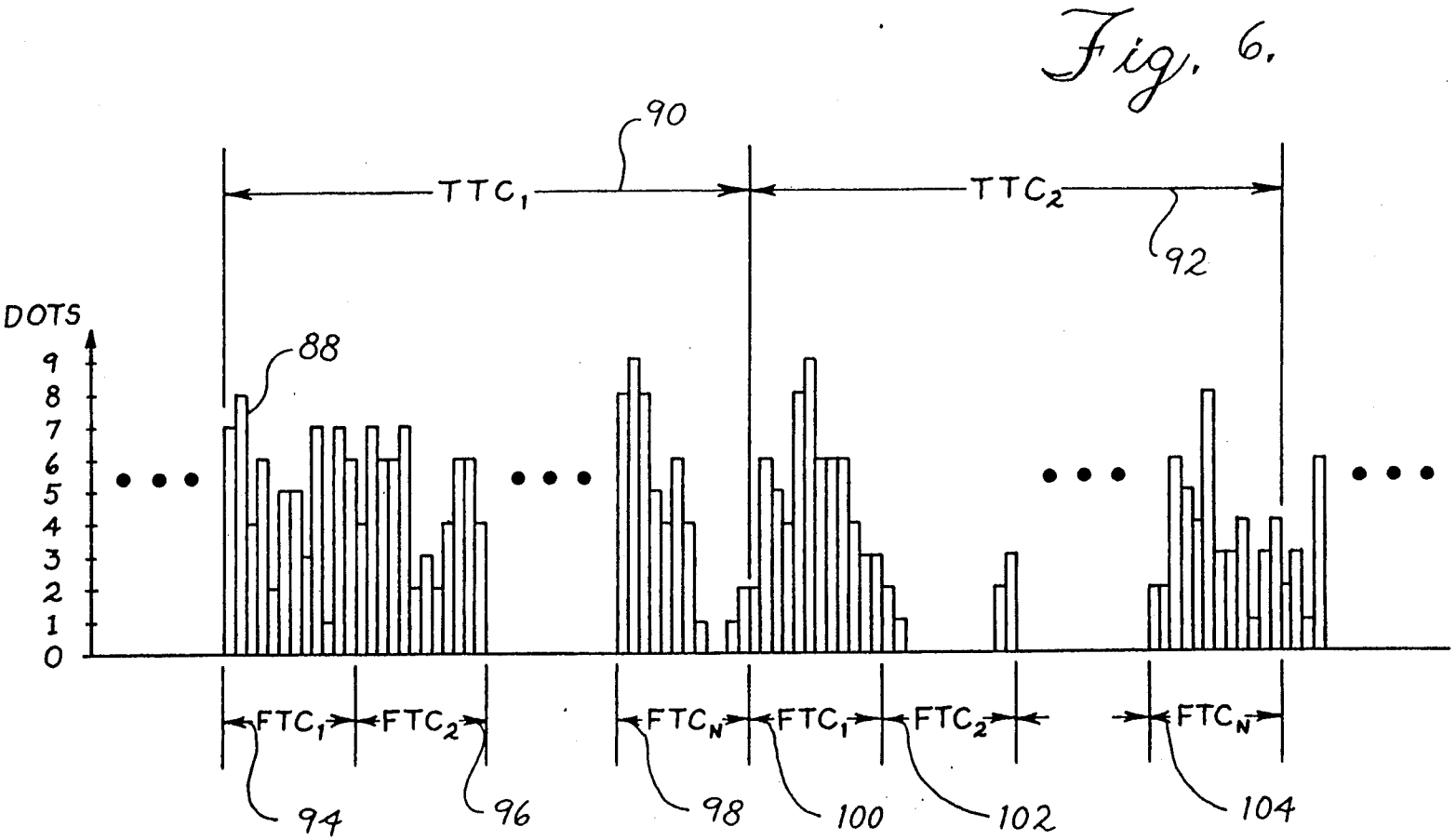
FIG. 6 illustrates the sampling intervals used in the power calculations of this invention.

FIG. 6 illustrates the sampling intervals used in the power calculations of this invention. An option period is defined as the shortest period during which the dots may be produced, or the wires fired. For example, option period 88 is one distinct location where up to nine different dots may be produced. In the illustration of FIG. 6, eight dots are actually produced during the option period 88. As can be seen, other option periods exist in the Figure which represent other amounts of dots produced during that particular option. It should be remembered that the amount of power required to print a specific number of dots is known from the design of the apparatus. In other words, the amount of power required to print the indicated number of dots for each option period is known.

The option periods are arranged into two groupings. A first grouping is indicated by thermal time constant (TTC) 90 and a second grouping is indicated by TTC 92. Time constants represent the time needed for the critical components to reach their critical temperature after being subjected to heat producing power. It is advantageous to group the option periods into thermal time constant periods so that the component will not increase in temperature before the controlling system has had a chance to decrease the speed of the printhead and consequently the dissipated power in the components. The thermal time constant represents the minimum time for the power supply critical components to reach maximum temperature under peak transient conditions. If the option window is too large, that is, greater than the thermal time constant, then the power supply components may get too hot before the calculation method can determine that a power reducing speed adjustment needs to be made. It is within the contemplation of the invention that specific option periods may be included in more than one TTC when different components have different thermal time constants which are being calculated at the same time.

Each thermal time constant interval or window is subdivided into filter time constant (FTC) time intervals each containing a plurality of option periods. The filter time constants 94 96 and 98 are three of the FTC periods included in the thermal time constant 90. The filter time constants 100, 102 and 104 are three of the time constant periods included in thermal time constant 92. The individual option periods within each filter time constant represents the number of dots to be printed at that option location. In the representation of FIG. 6, each filter time constant period has twelve option periods contained therein. Thus, a total of 108 dots may be printed within the filter time constant periods.

In order to determine an accurate RMS current value represented by the dot counts shown in FIG. 6, the method of this invention first processes the count numbers within the filter time constants, then relates the processed numbers to the overall thermal time constant corresponding to these filter time constants. By using the filter time constants, peak transients less than the filter time are not "seen" by the power supply. If the peak transients that are less than the filter time were not ignored in the calculations, the algorithm or method of this invention may reduce the printer speed unnecessarily. Consequently, it is important in this embodiment of the invention that the counting technique divides the option counts into groups dependent upon the effective filter time constant of the power supply. In usual applications, this time constant is within the range of 4 to 10 milliseconds. In any event, the filter time constant period in which the option periods are grouped should be within +or − 50% of the effective filter time constant of the power supply to make the RMS power controller system effective. In other words, if the filter time constant is 10 milliseconds the filter time constant periods used in the counting method should be between 5 and 15 milliseconds. Making the FTC's equivalent to the effective filter time constant produces the most twenty-five FTC's in each TTC window. In some cases, the RMS value for a single FTC may be used instead of adding squared counts for several time sequential FTC's before obtaining the square root.

True RMS current from the power supply can be calculated from the dot count and compared to a limit value to determine if an idle state or speed change is necessary in the printhead. The RMS current from the power supply can be represented as:

$$I_{rms}^2 = tf/kT\, I_{ave}^2\, [N_1 + N_2 + \ldots + N_k]^2 + ]N_{k+1} + N_{k+2} + \ldots + N_{2k}]^2 + \ldots + [N_{f-k} + N_{f-k+1} + \ldots + N_f]^2 \quad (8)$$

where:

tf = the wire fire period k = the maximum number of fires for a wire within the equivalent power supply response time T = time in the sampling interval $I_{ave}$ = the average current required to fire a single wire (one dot)

N = the number of wires (dots) that are fired in a given option period f = the total number of options within the sampling interval.

This leads to an RMS power limiting method, or algorithm, which can be accomplished in microprocessor code, by counting the number of dots according to:

$$K=[N_1+N_2+\ldots+N_k]^2+[N_{k+1}+N_{k+2}+\ldots+N_{2k}]^2+\ldots+[N_{f-k}+N_{f-k+1}+\ldots+N_f]^2 \quad (9)$$

The result is compared to a predetermined limit according to:

$$L=[I_{rms}/I_{ave}]^2\ kT/tf \quad (10)$$

where $I_{rms}$ is the desired RMS current limit for the power supply. If the limit is exceeded, the printer enters the idle state for a time interval given by:

$$T_{wait}=T\,[K/L-1] \quad (11)$$

Thus by calculating the idle time, $T_{wait}$, on a line by line basis, the printhead can be stopped after each print line and maintain a true RMS current limit in the power supply. Instead of stopping the printhead, the printhead speed can be reduced to maintain a true RMS current limit by the following relationship:

$$New\ Speed=Max\ Speed\ (L/K) \quad (12)$$

Figure 7:
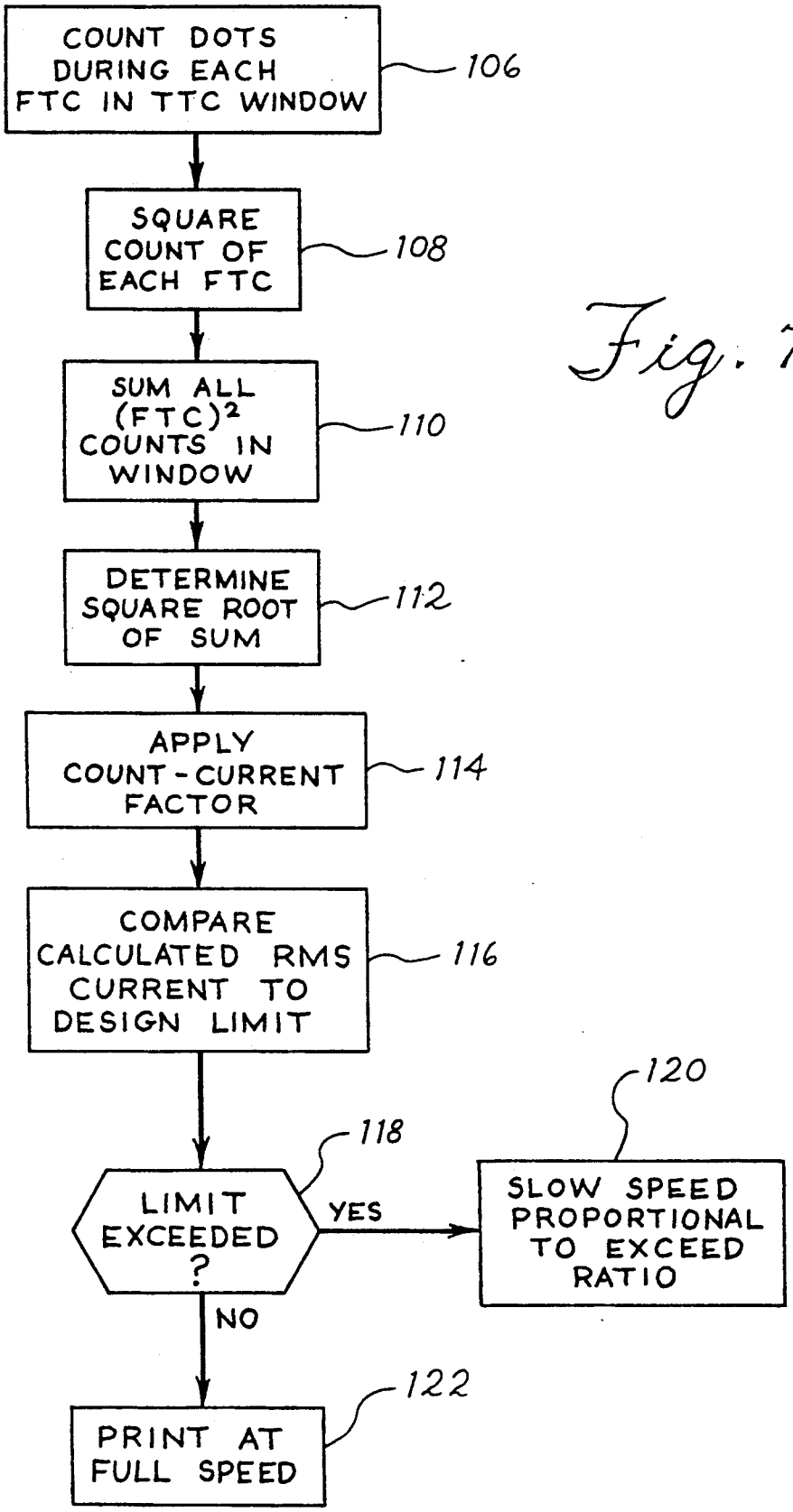
FIG. 7 is a flow chart illustrating the method used to control heat dissipation according to a specific embodiment of the invention.

FIG. 7 is a flow chart illustrating the method used to control heat dissipation according to this specific embodiment of the invention. The flow chart is illustrative of a microprocessor program which could be used to implement the mathematical and diagrammatic representations of the invention contained herein. According to FIG. 7, the system counts the number of dots during each filter time constant period within a thermal time constant window, as shown in block 106. These count numbers are then squared separately for each of the filter time constant periods, as indicated in block 108. Next, as shown in block 110, all of the squared filter time constant counts, $(FTC)^2$, are summed together to determine the overall squared count for the thermal time constant window. Next, the square root of this value is obtained according to block 112 and multiplied, or adjusted, by a count-current factor which turns the count number into a current quantity as indicated in block 114. For example, a conversion factor of 420 milliamps per dot can be used in a typical application to convert the dot count into a current quantity. Next, the calculated RMS current is compared to a design limit, as indicated in block 116, and, if the limit is exceeded, the effective printhead speed is reduced, as shown in blocks 118 and 120. If the limit is not exceeded, the printhead continues printing at the design speed of the apparatus without any attempt to slow the speed, as indicated in block 122.

By using the counting technique of this invention, counts can be used to accurately represent required power dissipation without unnecessarily indicating power transients which are filtered by the power supply components. This permits the use of a power supply which is more closely designed to match the thermal needs of the system without the necessity to over design the components due to inaccuracies existing with conventional dot counting techniques. This system of heat control may also be used for electrically controlled devices actually contained within the printhead driver circuits. It is emphasized that numerous changes may be made in the above-described system without departing from the teachings of the invention. For example, the teachings of this invention may also be used for determining the power dissipation in other components associated with the printhead, such as the drivers and solenoids which fire the wires. In addition, several different thermal time constant periods may be used during the calculations to take into account different thermal properties of different components. It is intended that all of the matter contained in the foregoing description, or shown in the accompanying drawings, shall be interpreted as illustrative rather than limiting.

What is claimed is:

1. A method of controlling heat dissipation in apparatus supplying or controlling power to a printhead having a plurality of selectable dot producing devices each energizable by a known amount of electrical power, said method including the steps of:

separately counting the dots printed, or to be printed, during a plurality of equal time intervals to produce a plurality of dot counts, with the duration of each said time interval being dependent upon an effective filter time constant characteristic of the power supplying or controlling apparatus, wherein said equal time intervals each have a duration which is within 50% of the effective filter time constant of the power supplying apparatus;

processing said dot counts to obtain a RMS value indicative of the RMS current required to supply or control the dot producing device over a time period equal to the total time of said plurality of equal time intervals;

comparing the RMS value with a predetermined limit value; and decreasing the effective rate at which the printhead forms dots when the comparison indicates that the RMS value exceeds, or will exceed, the limit value.

2. The heat dissipation controlling method of claim 1 wherein said time constant characteristic is dependent upon an effective filter time constant of the power supplying apparatus.

3. The heat dissipation controlling method of claim 1 wherein said time interval is substantially equal to the effective filter time constant of the power supplying apparatus.

4. The heat dissipation controlling method of claim 1 wherein said time constant characteristic is dependent upon a thermal time constant of the power controlling apparatus.

5. The heat dissipation controlling method of claim 1 wherein the step of deriving the first value includes the step of squaring the number of dot counts corresponding to the predetermined time interval.

6.The heat dissipation controlling method of claim 1 wherein the step of deriving the first value includes the steps of:

summing quantities derived from a plurality of time sequential predetermined intervals: and taking the square root of the obtained sum.

7. The heat dissipation controlling method of claim 1 wherein the second value is obtained by using a conversion factor with a dot count quantity, said factor being substantially equal to the current required for the printhead to produce one dot.

8. The heat dissipation controlling method of claim 1 wherein the limit value represents the minimum safe operating limit for power supply components.

9. The heat dissipation controlling method of claim 1 wherein the power supply components are in the primary portion of the power supply circuit.

10. The heat dissipation controlling method of claim 1 wherein the limit value represents the minimum safe operating for driver components associated with the printhead.

11. The heat dissipation controlling method of claim 1 wherein the step of processing the dot counts includes the steps of:

squaring the number of dots counted for each equal time interval;

summing the squared dot counts for all of said equal time intervals;

taking the square root of the obtained sum; and applying a conversion factor to the result, said factor representing the current required to produce one dot.

12. The heat dissipation controlling method of claim 1 wherein the total duration of the plurality of equal time intervals is related to a thermal time constant of one or more critical components in the apparatus being controlled.

13. Apparatus for controlling heat dissipation in power supplying or controlling devices associated with a dot-matrix printhead having a plurality of dot producing elements, said apparatus comprising:

means for separately counting the number of dots printer, or to be printed, in a plurality of sequential, predetermined time intervals, each of said time intervals being equal to each other and dependent upon an effective filter time constant of the power supplying or controlling apparatus wherein said equal time intervals each have a duration which is within 50% of the effective filter time constant of the power supplying apparatus;

means for processing said separate dot number counts to obtain a current value indicative of the RMS current needed to activate the dot producing elements;

means for comparing the current value with a predetermined limit value; and means for decreasing the heat dissipation in the associated power supplying or controlling devices when the comparison indicates that the current value exceeds, or will exceed, the limit value.

14. The heat dissipation controlling apparatus of claim 13 wherein the processing means also includes:

means for squaring the separate dot number counts;

means for summing the squared dot number counts; and means for taking the square root of the squared and summed dot number counts to provide an RMS quantity.

15. The heat dissipation controlling apparatus of claim 14 wherein the processing means also includes means for applying a conversion factor to the RMS quantity, said factor representing the current required to produce one dot.

* * * * *